US012302995B2

(12) United States Patent
Rilling et al.

(10) Patent No.: US 12,302,995 B2
(45) Date of Patent: May 20, 2025

(54) SHOE WITH BREAKAWAY PORTION TO MITIGATE RISK OF INJURY

(71) Applicant: Break Through Sports, PLLC, Scottsdale, AZ (US)

(72) Inventors: Richard Rilling, Scottsdale, AZ (US); Alan Pitas, Scottsdale, AZ (US)

(73) Assignee: Break Through Sports, PLLC, Scottsdale, AZ (US)

( * ) Notice: Subject to any disclaimer, the term of this patent is extended or adjusted under 35 U.S.C. 154(b) by 0 days.

(21) Appl. No.: 18/651,901

(22) Filed: May 1, 2024

(65) Prior Publication Data

US 2025/0057289 A1 Feb. 20, 2025

Related U.S. Application Data

(60) Provisional application No. 63/520,533, filed on Aug. 18, 2023.

(51) Int. Cl.

| | |
|---|---|
| ***A43C 15/16*** | (2006.01) |
| ***A43B 7/32*** | (2006.01) |
| ***A43B 13/28*** | (2006.01) |
| ***A43B 13/30*** | (2006.01) |

(52) U.S. Cl.

CPC ..... *A43C 15/161* (2013.01); *A43B 7/32* (2013.01); *A43B 13/30* (2013.01); *A43C 15/168* (2013.01); *A43C 15/162* (2013.01)

(58) Field of Classification Search

CPC ..... A43B 21/52; A43B 21/26; A43B 13/36; A43B 13/28; A43B 13/30; A43B 7/32; A43C 15/161; A43C 15/168; A43C 15/162

See application file for complete search history.

(56) References Cited

U.S. PATENT DOCUMENTS 1,631,710 A * 6/1927 Tranides ..... A43B 21/46 36/36 R
1,709,749 A * 4/1929 Shahbender ..... A43B 21/40 36/36 R
1,832,744 A * 11/1931 Morris ..... A43B 21/37 36/36 A (Continued)

OTHER PUBLICATIONS

Boden et al., Non-contact ACL Injuries: Mechanisms and Risk Factors. J Am Acad Orthop Surg. Sep. 2010; 18(9):520-527.

(Continued)

*Primary Examiner* — Katharine G Kane

(74) *Attorney, Agent, or Firm* — Casimir Jones, S.C.; Brian F. Bradley

(57) ABSTRACT

A shoe to mitigate the risk of an ACL tear by decreasing the impact force and preventing a twisting force to occur. A shoe comprising a sole with a toe section and a heel section; and a breakaway portion releasably coupled to the heel section with a release assembly. The release assembly includes an activation region positioned at a posterior end of the shoe. The breakaway heel portion releases from the sole when a threshold force is applied to the activation region. When an athlete lands on their heel in a "position of risk" with the body well behind the foot, the breakaway portion releases from the remainder of the shoe, such that the foot slides forward. Since the foot is not anchored in the ground, the damaging twisting force does not occur.

20 Claims, 10 Drawing Sheets

(56) References Cited

U.S. PATENT DOCUMENTS

| | | | | | |
|---|---|---|---|---|---|
| 2,038,606 | A * | 4/1936 | Sarkadi | A43B 21/52 | 36/36 R |
| 2,252,404 | A * | 8/1941 | Mauser | A43B 21/39 | 36/36 R |
| 2,582,551 | A * | 1/1952 | Malherbe | A43B 21/39 | 74/594.6 |
| 3,188,755 | A * | 6/1965 | Cortina | A43B 21/40 | 36/42 |
| 3,192,652 | A * | 7/1965 | Melchiorre | A43B 21/48 | D2/964 |
| 3,193,949 | A * | 7/1965 | Cortina | A43B 21/39 | 36/42 |
| 3,318,025 | A * | 5/1967 | Barriga | A43B 13/36 | 36/36 B |
| 3,646,497 | A * | 2/1972 | Gillikin | A43B 21/39 | 36/58.5 |
| 3,668,792 | A | 6/1972 | York | | |
| 3,982,336 | A * | 9/1976 | Herro | A43B 5/02 | 36/62 |
| 4,214,384 | A * | 7/1980 | Gonzalez | A43B 21/39 | 74/594.6 |
| 4,739,564 | A * | 4/1988 | Eser | B62M 3/086 | 36/134 |
| 5,025,574 | A * | 6/1991 | Lasher, III | A43B 21/40 | 36/36 R |
| 5,224,810 | A | 7/1993 | Pitkin | | |
| 5,255,453 | A | 10/1993 | Weiss | | |
| 5,317,822 | A * | 6/1994 | Johnson | A43B 13/36 | 36/15 |
| 5,373,649 | A | 12/1994 | Choi | | |
| 5,456,026 | A * | 10/1995 | Lewis | A43B 21/36 | 36/36 R |
| 5,615,497 | A * | 4/1997 | Meschan | A43B 21/433 | 36/31 |
| 5,617,653 | A | 4/1997 | Walker et al. | | |
| 5,644,857 | A * | 7/1997 | Ouellette | A43B 3/24 | 36/15 |
| 5,692,322 | A * | 12/1997 | Lombardino | A43B 3/24 | 36/36 A |
| 6,065,228 | A * | 5/2000 | Begey | A43B 5/0417 | 36/117.3 |
| 7,254,905 | B2 | 8/2007 | Dennison | | |
| 7,654,014 | B1 * | 2/2010 | Moore | A43B 5/001 | 36/134 |
| 7,975,405 | B1 * | 7/2011 | Kemp | A43B 3/24 | 36/100 |
| 8,069,583 | B1 | 12/2011 | Simchuk | | |
| 2002/0078601 | A1 * | 6/2002 | Alfond | A43B 21/52 | 36/130 |
| 2003/0131503 | A1 * | 7/2003 | Erickson | A43B 13/10 | 36/28 |
| 2004/0221486 | A1 | 11/2004 | Dennison | | |
| 2005/0172518 | A1 | 8/2005 | Ungari | | |
| 2005/0278979 | A1 * | 12/2005 | Bramani | A43B 13/26 | 36/15 |
| 2006/0254086 | A1 * | 11/2006 | Meschan | A43B 13/26 | 36/25 R |
| 2010/0122473 | A1 * | 5/2010 | Santos | A43B 5/008 | 36/15 |
| 2011/0179670 | A1 * | 7/2011 | Lepour | A43B 21/40 | 36/42 |
| 2012/0036739 | A1 | 2/2012 | Amos et al. | | |
| 2012/0260534 | A1 * | 10/2012 | Guer | A43C 15/02 | 36/134 |
| 2016/0073725 | A1 * | 3/2016 | Guenoun | A43B 13/36 | 36/100 |
| 2016/0081429 | A1 * | 3/2016 | Derrick | A43B 3/246 | 36/15 |
| 2016/0331080 | A1 * | 11/2016 | Weaver | A43B 21/39 | |
| 2019/0297989 | A1 * | 10/2019 | Adamson | A43B 13/122 | |
| 2021/0100319 | A1 | 4/2021 | Kelleher et al. | | |
| 2024/0156212 | A1 * | 5/2024 | Gomez | A43B 3/44 | |

OTHER PUBLICATIONS

Boden et al., Mechanism of non-contact ACL injury: OREF Clinical Research Award 2021. Journal of Orthopaedic Research. 2022, 40(3), 531-540.

Carlson et al., Video Analysis of Anterior Cruciate Ligament (ACL) Injuries. JBJS Rev. Nov. 29, 2016; 4(11): e5. 12 pages.

Della Villa et al., Systematic Video Analysis of Anterior Cruciate Ligament Injuries in Professional Male Rugby Players: Pattern, Injury Mechanism, and Biomechanics in 57 Consecutive Cases. Orthop J Sports Med. Nov. 2021; 9(11): 23259671211048182. 11 pages.

Doyle. ACL Protective Footwear Design. Biomedical Engineering & Mechanical Engineering. Worcester Polytechnic Institute. Apr. 26, 2012, 89 pages.

Kim-Wang et al., Distribution of bone contusion patterns in acute non-contact ACL torn knees. Am J Sports Med. Feb. 2021; 49(2):404-409.

Koga et al., Hip and Ankle Kinematics in Noncontact Anterior Cruciate Ligament Injury Situations: Video Analysis Using Model-Based Image Matching. Am J Sports Med. Feb. 2018; 46(2): 333-340.

Lin et al., Biomechanical risk factors of non-contact ACL injuries: A stochastic biomechanical modeling study. Journal of Sport and Health Science. 2012, 1(1), 36-42.

Montgomery et al., Mechanisms of ACL injury in professional rugby union: a systematic video analysis of 36 cases. Br J Sports Med, 2016; 0: 1-8.

Petway et al., Mechanisms of Anterior Cruciate Ligament Tears in Professional National Basketball Association Players: A Video Analysis. Journal of Applied Biomechanics. 2023, 39, 143-150.

Sasaki et al., The Relationships Between the Center of Mass Position and the Trunk, Hip, and Knee Kinematics in the Sagittal Plane: A Pilot Study on Field-Based Video Analysis for Female Soccer Players. J Hum Kinet. Mar. 29, 2015; 45: 71-80.

Schick et al., The Mechanism of Anterior Cruciate Ligament Injuries in the National Football League: A Systematic Video Review. Cureus. Jan. 2023; 15(1): e34291. 8 pages.

Sipprell et al., Dynamic Sagittal-Plane Trunk Control During Anterior Cruciate Ligament Injury. Am J Sports Med. May 2012; 40(5): 1068-1074.

Yu et al., Mechanisms of non-contact ACL injuries. Br J Sports Med. Aug. 2007; 41 (Suppl 1): i47-i51.

International Search Report and Written Opinion for PCT/US/2024/034613, mailed Sep. 25, 2024, 9 pages.

* cited by examiner

SHOE WITH BREAKAWAY PORTION TO MITIGATE RISK OF INJURY

RELATED APPLICATIONS

This application claims priority to and the benefit of U.S. Provisional Patent Application No. 63/520,533, filed Aug. 18, 2023, which is incorporated herein by reference in its entirety for all purposes.

TECHNICAL FIELD

This disclosure relates to shoes to prevent or reduce the risk of injury.

BACKGROUND

Most anterior cruciate ligament (ACL) injuries involve minimal to no contact. Understanding the mechanism of injury is important to optimize prevention strategies. Several theories and risk factors have been proposed to explain the mechanism of non-contact ACL injury, including impingement on the intercondylar notch, quadriceps contraction, the quadriceps-hamstring force balance, and axial compressive forces on the lateral aspect of the joint.

U.S. patent application Ser. No. 16/903,693 discloses an athletic shoe with two separate components that can detach from one another in response to a critical pivoting force applied at the toe region in order to reduce or prevent knee injury to the wearer.

SUMMARY

The disclosure provides, in one aspect, a heel assembly comprising a base; a breakaway portion; and a frangible fastener positioned in a first region. The frangible fastener releasably couples the breakaway portion to the base. The breakaway portion is released from the base in response to application of a threshold force applied to a second region. The second region is posterior the first region.

In some embodiments, the heel assembly further includes a gap positioned between the breakaway portion and the base.

In some embodiments, the gap is positioned in the second region.

In some embodiments, the base includes a base mount positioned within the first region, wherein the base mount includes an interface surface and an aperture formed in the interface surface; wherein the frangible fastener is at least partially positioned within the aperture.

In some embodiments, the base includes a cutout positioned in the second region, wherein the cutout includes a cutout surface spaced apart from the breakaway portion.

In some embodiments, the base includes an arcuate surface positioned between the interface surface and the cutout surface.

In some embodiments, the breakaway portion includes a breakaway mount including a slot, wherein the frangible fastener is at least partially positioned within the slot.

In some embodiments, the breakaway mount includes an interface surface, wherein the interface surface abuts the base when the breakaway portion is coupled to the base.

In some embodiments, the breakaway portion includes a ramp surface and an arcuate surface positioned between the interface surface and the ramp surface.

In some embodiments, the breakaway portion includes a ridge extending from the interface surface, wherein the ridge abuts the base when the breakaway portion is coupled to the base.

In some embodiments, the base includes a base mount with an anterior surface, and wherein the ridge abuts the anterior surface when the breakaway portion is coupled to the base.

In some embodiments, the base includes a first lateral notch and a second lateral notch. The breakaway portion includes a first finger at least partially positioned within the first lateral notch when the breakaway portion is coupled to the base, and a second finger at least partially positioned within the second lateral notch when the breakaway portion is coupled to the base.

In some embodiments, the breakaway portion includes at least one cleat.

In some embodiments, the frangible fastener includes a bolt and a nut.

In some embodiments, the heel assembly further includes a pivot interface between the base and the breakaway portion, wherein the pivot interface is positioned between the first region and the second region.

In some embodiments, the pivot interface defines a pivot axis, and wherein the pivot axis is horizontal.

In some embodiments, the base includes a ledge, and wherein the breakaway portion includes a finger with a hook abutting a top surface of the ledge when the breakaway portion is coupled to the base.

The disclosure provides, in one aspect, a shoe comprising: a sole with a toe section and a heel section; and a breakaway portion releasably coupled to the heel section with a release assembly. The release assembly includes an activation region positioned at a posterior end of the shoe. The breakaway heel portion releases from the sole when a threshold force is applied to the activation region.

In some embodiments, the release assembly includes at least one frangible fastener, and wherein the release assembly includes a pivot interface and a gap positioned between the heel section and the breakaway portion.

In some embodiments, the shoe is a tennis shoe, a basketball shoe, an athletic shoe, a baseball shoe, a football shoe, a soccer shoe, or a cleated shoe.

Other aspects of the disclosure will become apparent by consideration of the detailed description and accompanying drawings.

BRIEF DESCRIPTION OF THE DRAWINGS

These and other features, aspects, and advantages of the present technology will become better understood with regards to the following drawings. The accompanying figures and examples are provided by way of illustration and not by way of limitation.

Figure 1A:
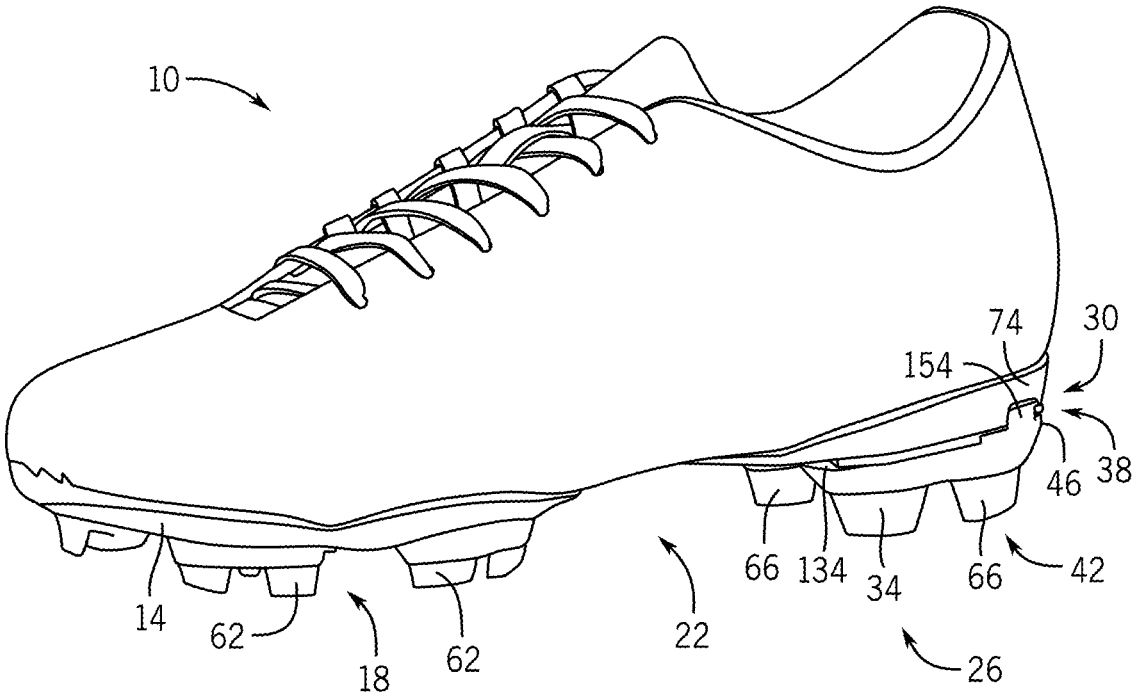
FIG. 1A is a perspective view of a shoe with a breakaway portion shown in an attached configuration.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The term "coupled," as used herein, is defined as "connected," although not necessarily directly, and not necessarily mechanically. The term coupled is to be understood to mean physically, magnetically, chemically, fluidly, electrically, or otherwise coupled, connected or linked and does not exclude the presence of intermediate elements between the coupled elements absent specific contrary language.

Non-contact ACL injuries account for greater than 70 percent of all ACLT. One mode of injury occurs when the person lands on their heel, with the body behind the knee and foot. This at risk position includes increased hip flexion averaging 50 degrees, near full knee extension, and less than normal ankle plantar flexion (average less than 10 degrees). In short, the athlete gets behind the foot and impacts the heel. Generally, the athlete is reacting to something that was not anticipated. Recent examples of professional athletes include Robert Toyan running past a teammate that gets blocked into him, Odell Bechham catching a pass thrown behind him, and Jimmy Garrappalo trying to evade a defensive back cutting off the sideline.

Landing in this "position of risk" causes an ACL tear with two main mechanisms. The first mechanism is a large impact force. In normal activity the athlete lands on the mid or forefoot and the gastroc complex is able to decrease the impaction force by increasing the time over which the impact occurs. Impact force is defined as the change in momentum/change in time. By increasing the time of impact the impact force is decreased significantly. When the athlete lands in the "position of risk" the gastroc complex cannot function in this capacity. When the heel is impacted without the slowing function of the gastroc, the time of impact decreases and therefore the impact force is dramatically increased. We see evidence of this impact force with MRI studies in non-contact ACL injuries showing a bone contusion rate of 80-99 percent. The second mechanism is a twisting force. When the athlete lands in the "position of risk" the leg moves into a valgus (e.g., knocked kneed) alignment. This causes the femur to internally rotate secondary to a more constrained medial and less constrained lateral side of the knee. As the ACL has now been determined to originate off the posterior lateral femoral condyle it follows that this femoral internal rotation will shear off the ACL at its origin.

The described athletic shoe may mitigate the risk of an ACL tear in this non-contact injury mechanism in two ways. The first is a decrease in the impact force. As the cleat releases with heel impact the foot slides. The sliding increases the time of impact and in some respects acts to dissipate the impact force similar to how the gastroc complex normally would. The second mechanism is not allowing a twisting force to occur. When the athlete lands on the heel in this "position of risk" with the body well behind the foot, as the foot slides the athlete will likely fall. If the foot is not anchored in the ground the twisting force cannot occur and the ACL cannot tear.

With reference to FIG. 1A, a shoe 10 includes a sole 14 with a toe section 18, an arch section 22, and a heel section 26. A heel assembly 30 is positioned in the heel section 26. As detailed further herein, a breakaway portion 34 is releasably coupled to the heel section 26 with a release assembly 38. The release assembly 38 includes an activation region 42 positioned at a posterior end 46 of the shoe 10. In the illustrated embodiment, the activation region 42 is positioned to overlap with the heel of a wearer of the shoe 10. The release assembly 38 includes at least one frangible fastener 50, a pivot interface 54 positioned posterior to the fasteners 50, and a gap 58 positioned posterior to the pivot interface 54. The breakaway portion 34 releases from the sole 14 when a threshold force is applied to the activation region 42. In other words, the breakaway portion 34 breaks loose when isolated heel-first contact is initiated with the ground.

In the illustrated embodiment, the shoe 10 is a cleated shoe with front cleats 62 and rear cleats 66. In the illustrated embodiment, the breakaway portion 34 includes at least one rear cleat 66. In other embodiments, the shoe 10 is any type of shoe or footwear, including but not limited to, an athletic shoe, a tennis shoe, a basketball shoe, a baseball shoe, a football shoe, a soccer shoe, a cleated shoe, or similar shoe. Disclosed herein is sole releasing technology initiated with heel contact or impact suitable for any footwear.

Figure 1B:
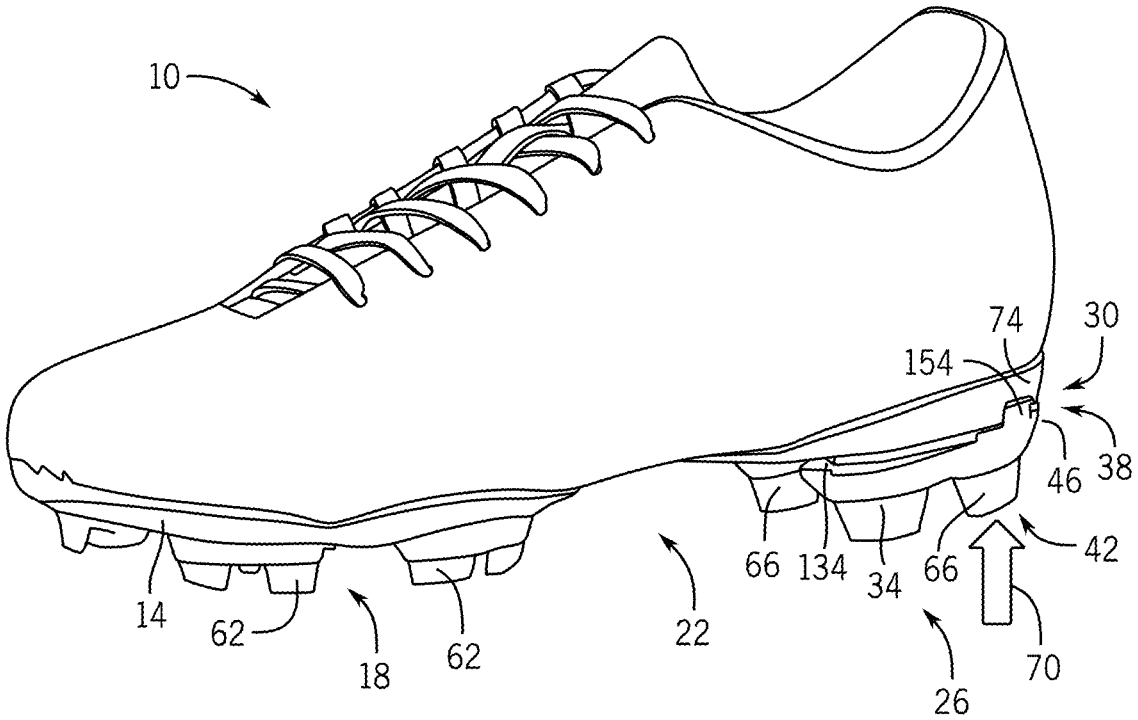
FIG. 1B is a perspective view of the shoe of FIG. 1A, with the breakaway portion shown in a released configuration.

With reference to FIG. 1B, the shoe 10 is illustrated with the breakaway portion 34 released from the heel section 26 in response to a threshold force 70 applied to the activation region 42. As detailed herein, the breakaway portion 34 is stable during normal use and releases only in response to the threshold forced 70 being applied at the activation region 42 (e.g., the wearer's heel). In other words, the breakaway portion 34 at the heel comes off the shoe 10 with isolated heel contact.

Figure 1C:
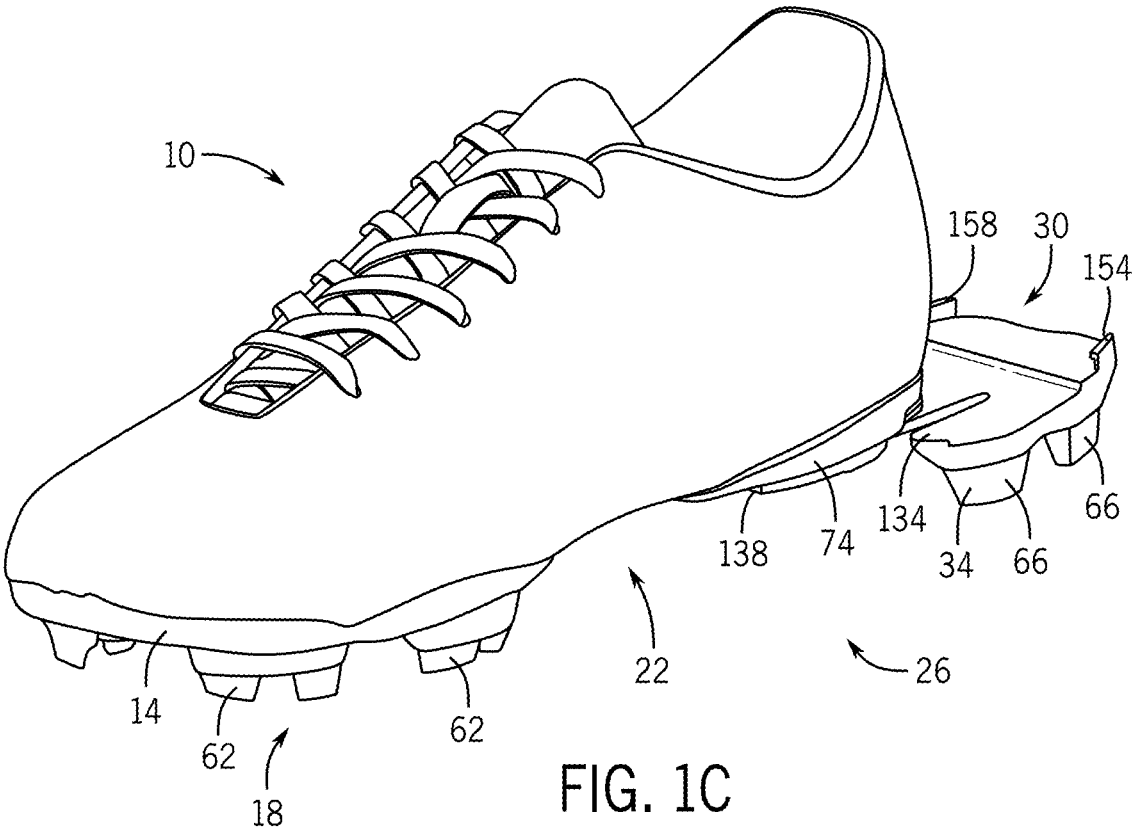
FIG. 1C is a perspective view of the shoe of FIG. 1A, with the breakaway portion shown in a released configuration and separated further from the remainder of the shoe.

With reference to FIG. 1C, the shoe 10 is illustrated with the breakaway portion 34 released from the heel section 26 and further separated from the remainder of the shoe 10. As a result of the breakaway portion 34 being released from the sole 14, the rest of the shoe 10 slides forward. In some embodiments, the breakaway portion 34 stays stable in the ground as the rest of the shoe 10 continues to move or slide forward. In some instances, the wearer will fall but the rate of ACL tear decreases with the foot not anchored in the ground. In other words, a foot that is not anchored to the ground will not tear the ACL.

Figure 2:
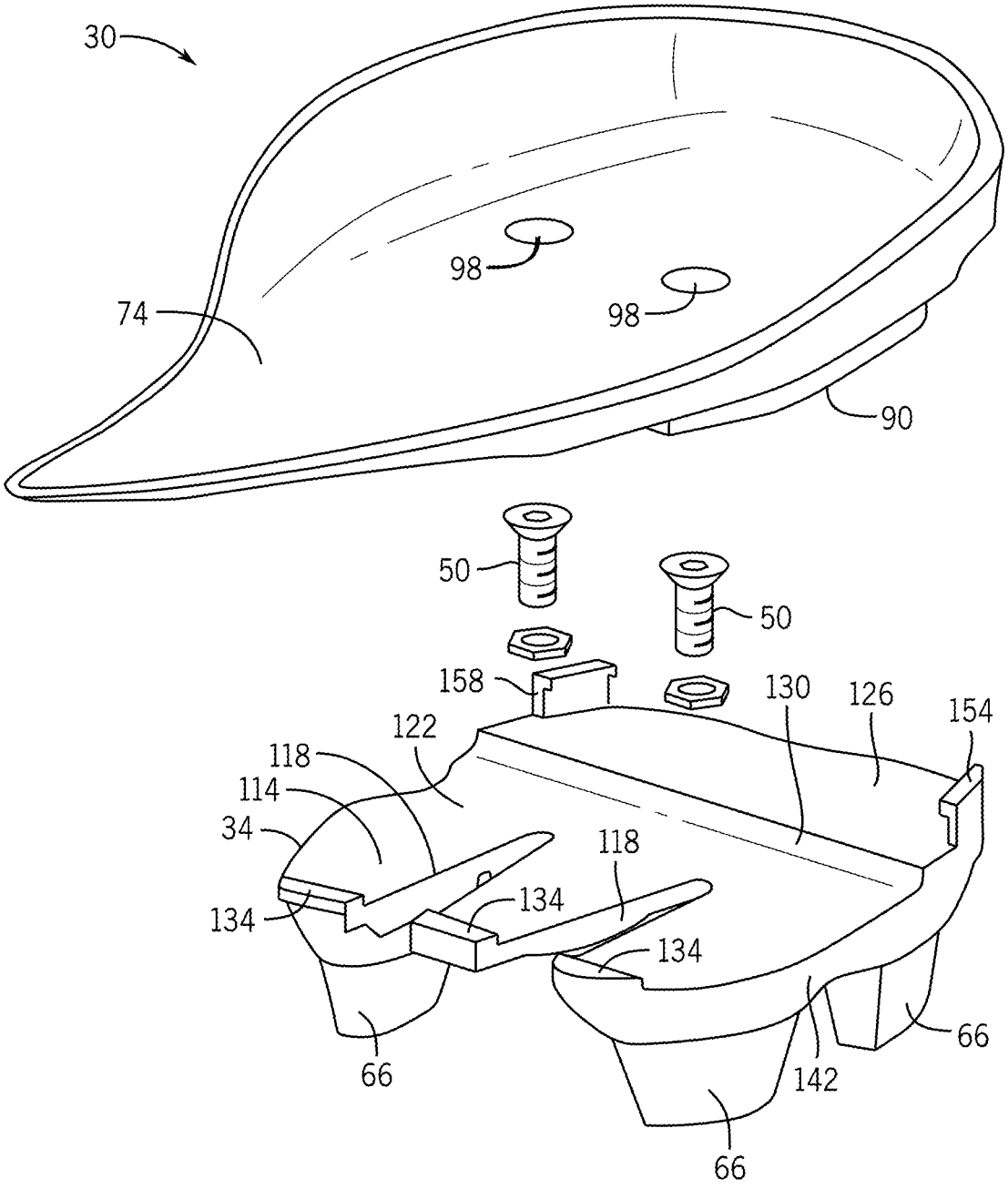
FIG. 2 is a top exploded view of a heel assembly including a breakaway portion.
Figure 3:
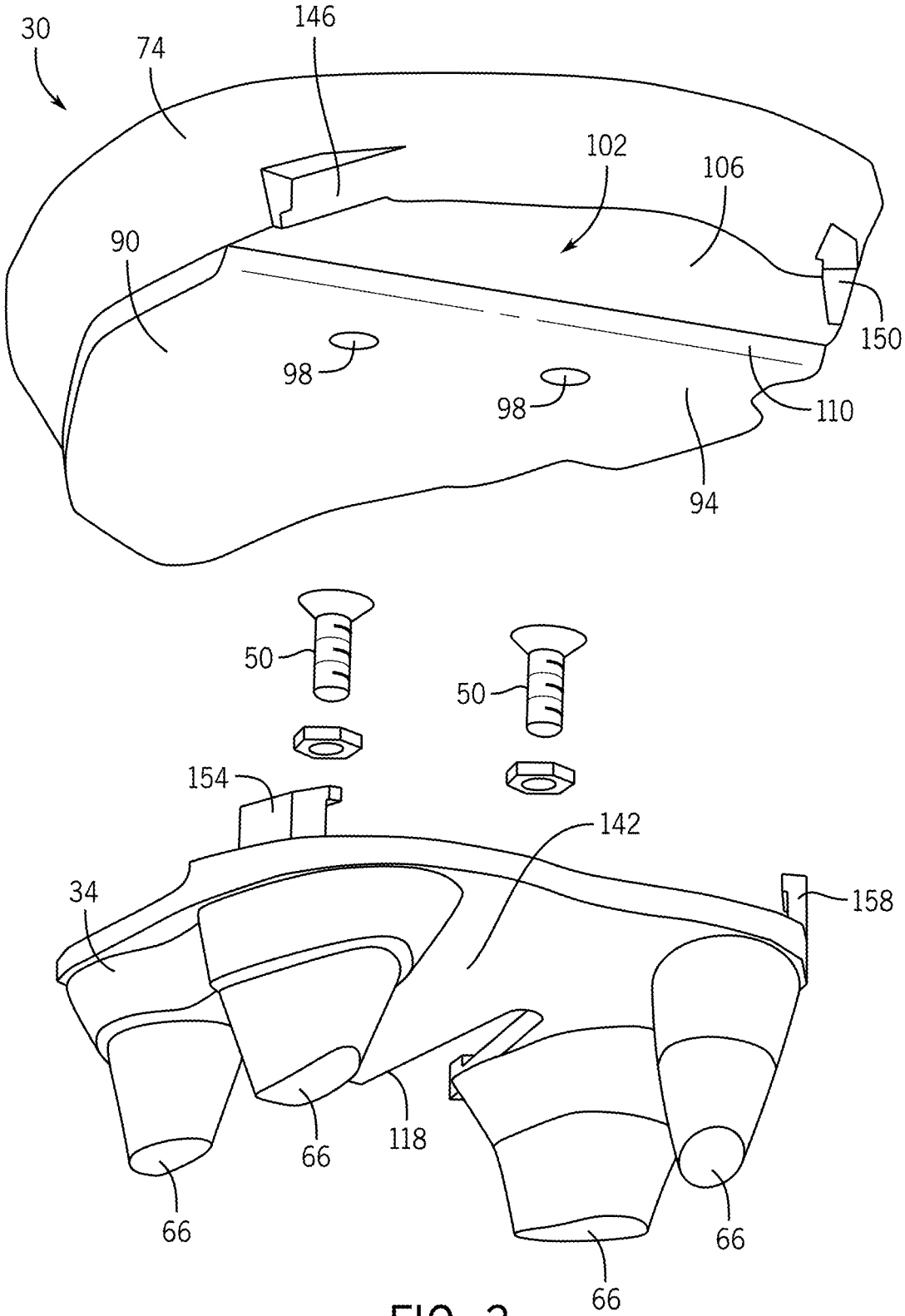
FIG. 3 is a bottom exploded view of the heel assembly of FIG. 2.

With reference to FIGS. 2 and 3, the heel assembly 30 includes a base 74, the breakaway portion 34, and the frangible fasteners 50. The heel assembly 30 includes a first region 78 (e.g., a front region, an anterior region) and a second region 82 (e.g., a rear region, a posterior region). In the illustrated embodiment, the second region 82 is posterior the first region 78. The frangible fasteners 50 are positioned in the first region 78 and the frangible fasteners 50 releasable couple the breakaway portion 34 to the base 74. In the illustrated embodiment, each frangible fastener 50 includes a bolt and a nut.

Figure 4:
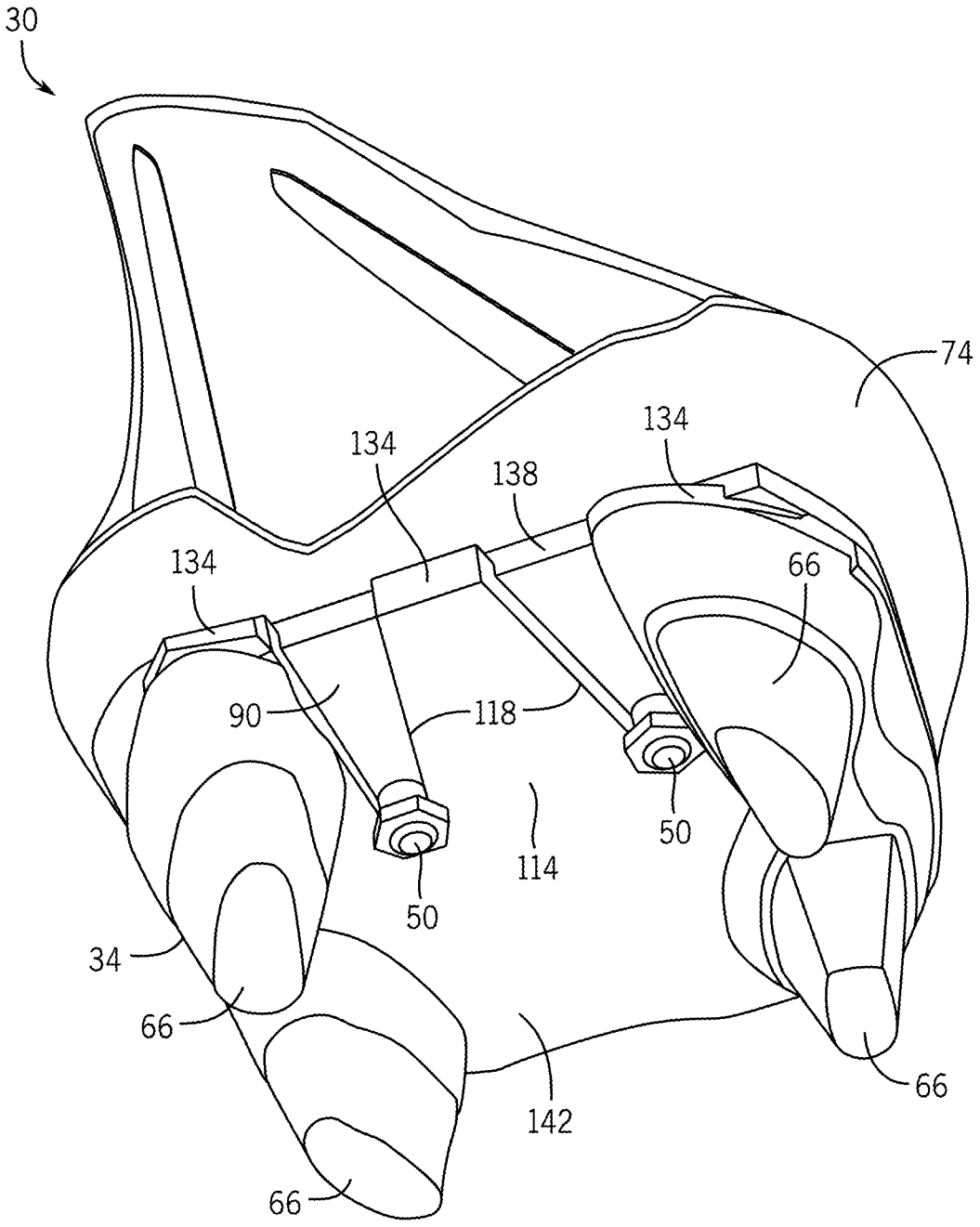
FIG. 4 is a bottom perspective view of a heel assembly, with a breakaway portion shown in an attached configuration.
Figure 5:
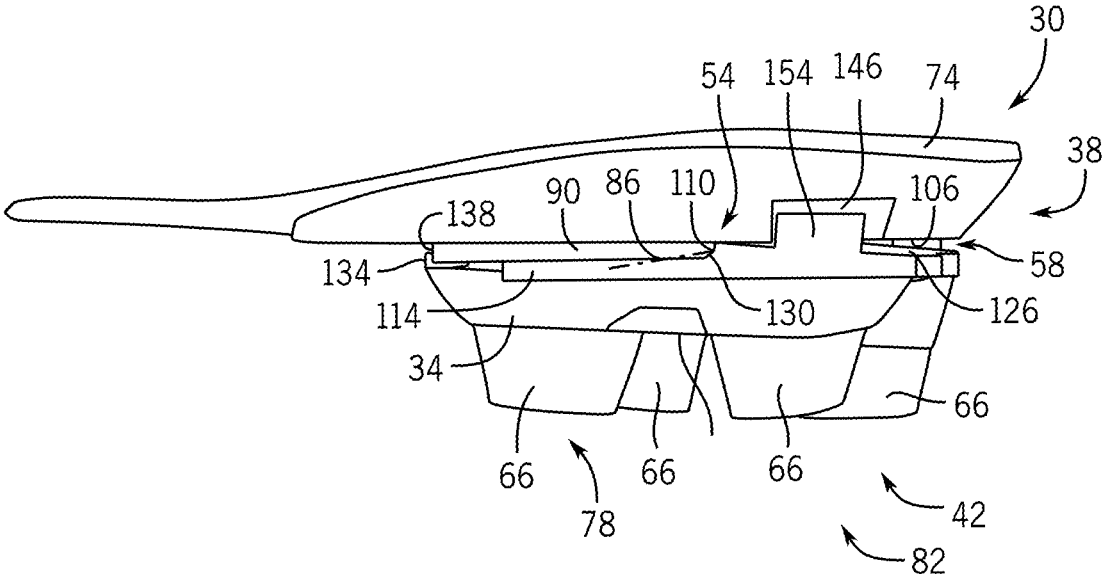
FIG. 5 is a side view of the heel assembly of FIG. 4.
Figure 6:
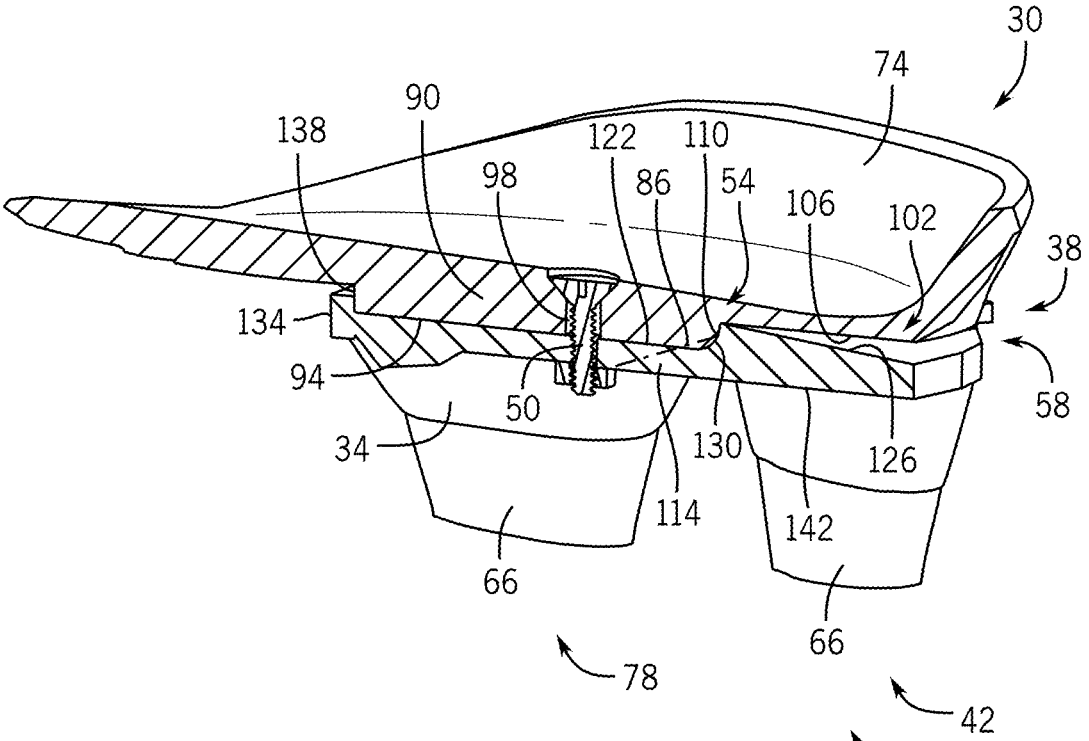
FIG. 6 is a perspective view of a cross-section of the heel assembly of FIG. 4.

With reference to FIGS. 4, 5, and 6, the breakaway portion 34 is illustrated attached to the base 74 (e.g., in the attached configuration). The gap 58 is positioned between the breakaway portion 34 and the base 74 in the attached configuration. In the illustrated embodiment, the gap 58 is positioned in the second region 82. As detailed further herein, the breakaway portion 34 is released from the base 74 in response to application of a threshold force applied to the second region 82. In the illustrated embodiment, the activation region 42 overlaps with the second region 82. In some embodiments, the threshold force is approximately two times the body weight of the wearer. In some embodiments, the threshold force is within a range of approximately two times to approximately three times the body weight of the wearer. In the illustrated embodiment, the pivot interface 54 is positioned between the base 74 and the breakaway portion 34. The pivot interface 54 is positioned between the first region 78 and the second region 82. In some embodiments, the pivot interface 54 defines a pivot axis 86 and the pivot axis 86 is horizontal when the shoe 10 is placed on a flat horizontal surface.

With continued reference to FIGS. 2 and 3, the base 74 includes a base mount 90 positioned within the first region 78. The base mount 90 includes an interface surface 94 and apertures 98 formed in the interface surface 94. In the illustrated embodiment, each of the frangible fasteners 50 is at least partially positioned within a corresponding one of the apertures 98. The base 74 includes a cutout 102 positioned in the second region 82, and the cutout 102 includes a cutout surface 106. In the illustrated embodiment, the cutout surface 106 is spaced apart from the breakaway portion 34 in the attached configuration (FIG. 6). In the illustrated embodiment, the base 74 includes an arcuate surface 110 positioned between the interface surface 94 and the cutout surface 106.

With continued reference to FIGS. 2 and 3, the breakaway portion 34 includes a breakaway mount 114 including at least one slot 118. Each of the frangible fasteners 50 is at least partially positioned within a corresponding slot 118. In the illustrated embodiment, there are two frangible fasteners 50 and two corresponding slots 118. In other embodiments, the shoe includes any number of frangible fasteners and slots, including a single frangible fastener and a single slot. The breakaway mount 114 includes an interface surface 122. In the illustrated embodiment, the interface surface 122 abuts the base 74 when the breakaway portion 34 is coupled to the base 74 (e.g., the attached configuration). In the illustrated embodiment, the interface surface 122 of the breakaway portion 34 abuts the interface surface 94 of the base 74.

The breakaway portion 34 further includes a ramp surface 126 and an arcuate surface 130 positioned between the interface surface 122 and the ramp surface 126. In the illustrated embodiment, the arcuate surfaces 110, 130 engage to create the pivot interface 54. In some embodiments, the pivot axis 86 is tangent to both the arcuate surfaces 110, 130.

With reference to FIG. 4, the breakaway portion 34 includes at least one ridge 134 extending from the interface surface 122. The ridge 134 abuts the base 74 when the breakaway portion 34 is coupled to the base 74 (e.g., the attached configuration). In the illustrated embodiment, the base mount 90 includes an anterior surface 138 and the ridge 134 abuts the anterior surface 138 in the attached configuration. The breakaway portion 34 includes a bottom surface 142. The rear cleats 66 extend from the bottom surface 142. In the illustrated embodiments, the slots 118 extend from the interface surface 122 to the bottom surface 142.

With reference to FIGS. 2 and 3, the base 74 includes a first lateral notch 146 and a second lateral notch 150 (e.g., a notch on each side of the base). The breakaway portion 34 includes a first finger 154 at least partially positioned within the first lateral notch 146 when the breakaway portion 34 is coupled to the base 74 (FIG. 5). Similarly, the breakaway portion 34 includes a second finger 158 at least partially positioned within the second lateral notch 150 when the breakaway portion 34 is coupled to the base 74. In the illustrated embodiment, the fingers 154, 158 are hooks positioned on each side of the breakaway portion 34 and provide improved side-to-side cutting stability (e.g., lateral stability).

With reference to FIGS. 5 and 6, in the attached configuration, the breakaway portion 34 is attached to the base 74. The nuts of the frangible fasteners 50 are holding the breakaway portion 34 tight against the base 74. The ridge 134 prevents the base 74 from sliding forward with respect to the breakaway portion 34. Fingers 154, 158 provide lateral and rotational stability between the breakaway portion 34 and the base 74. As such, the shoe 10 supports the wearer as would a conventional shoe in the attached configuration. In the illustrated embodiment, the ridge 134 is positioned anterior to the pivot interface 54 and the fingers 154, 158 are positioned posterior to the pivot interface 54.

Figure 7:
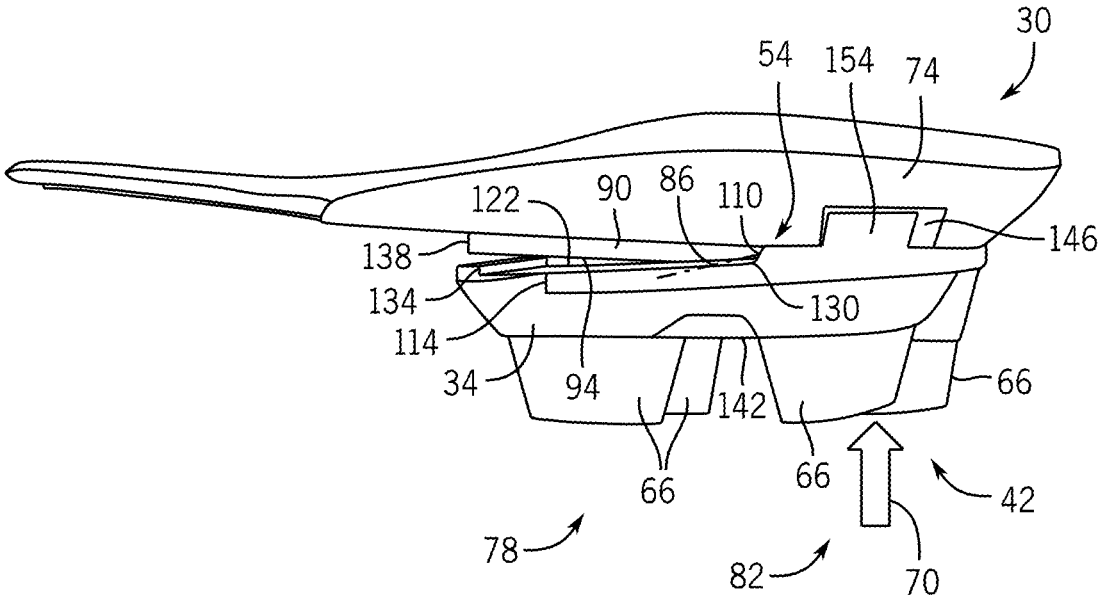
FIG. 7 is a side view of the heel assembly, with a breakaway portion shown in a released configuration.
Figure 8:
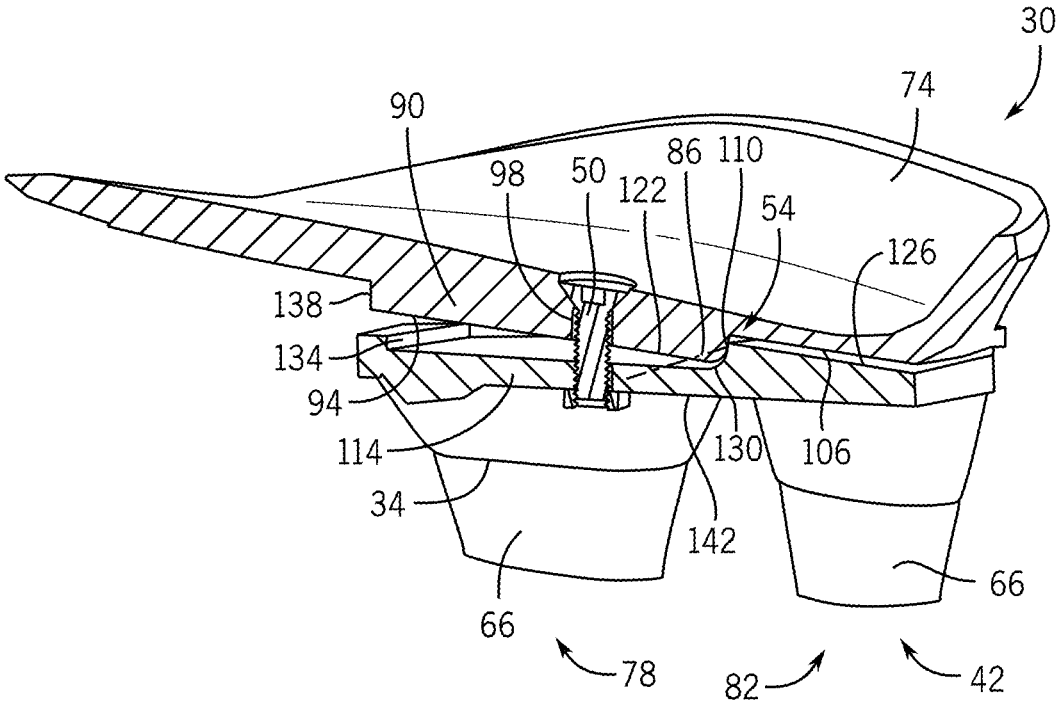
FIG. 8 is a perspective view of a cross-section of the heel assembly of FIG. 7.

With reference to FIGS. 7 and 8, in the released configuration, the breakaway portion 34 is released from the base 74. The threshold force 70 has been applied to the activation region 42 causing the frangible fasteners 50 to break. In some embodiments, the nuts shear off the bolts. In some embodiments, the nuts strip or otherwise fail. Relative rotation of the base 74 about the axis 86 with respect to the breakaway portion 34 occurs at the pivot interface 54 to reduce the size of the gap 58. After rotation, the anterior surface 138 is spaced from the ridge 134. As such, the base 74 is then free to slide forward relative to the breakaway portion 34, which prevents the foot from producing a large impulse force to the lower leg and knee.

In operation, when a wearer of the shoe 10 lands on their heel, the breakaway portion 34 releases causing the wearer to slip and fall or at a minimum not provide a stable point to anchor the foot for the knee to twist off from. As the wearer lands on the heel, the frangible fasteners break and wearer's foot slides forward with respect to the breakaway portion 34.

As detailed herein, the release assembly 38 is only activated upon a wearer landing on their heel. In response to the threshold force being applied to the heel, only a heel component is released. By releasing the breakaway portion 34, the forces are dissipated, and twisting is prevented.

In some embodiments, threads are additively manufactured into apertures in the base and sheer fasteners are interested through the breakaway portion and into the threaded apertures. In other words, the frangible fastener is at least partially received within a threaded aperture of the base. Any portion of the frangible fastener breaks or fails to release the breakaway portion. With the sheering component additively manufactured into the base, the shoe is more easily assembled and has less parts.

Figure 9:
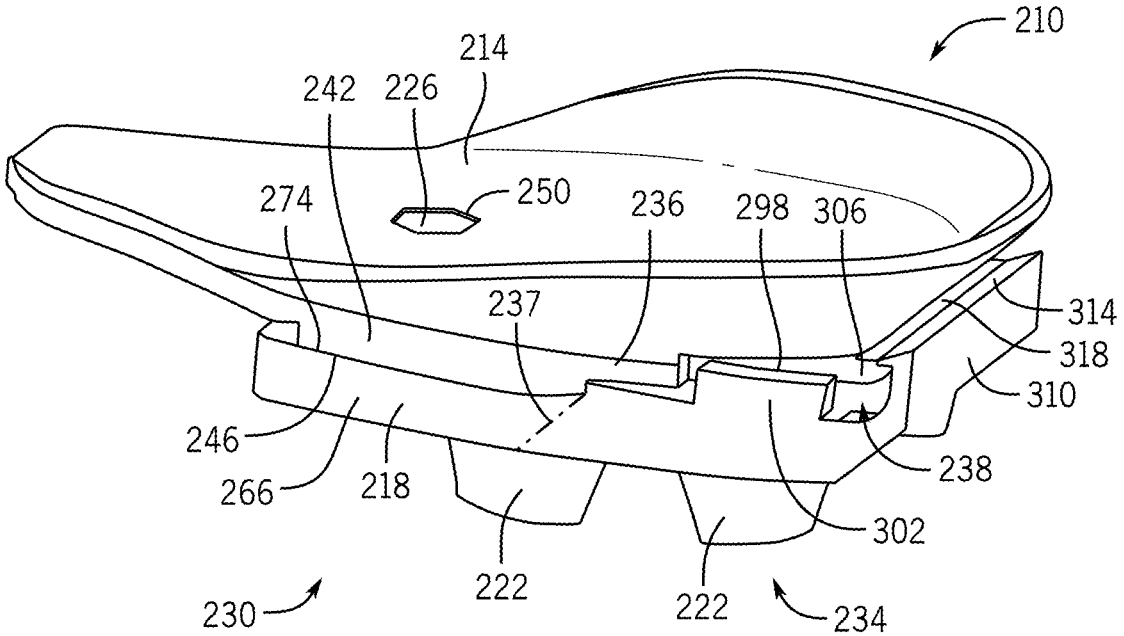
FIG. 9 is a perspective view of a heel assembly including a breakaway portion.
Figure 10:
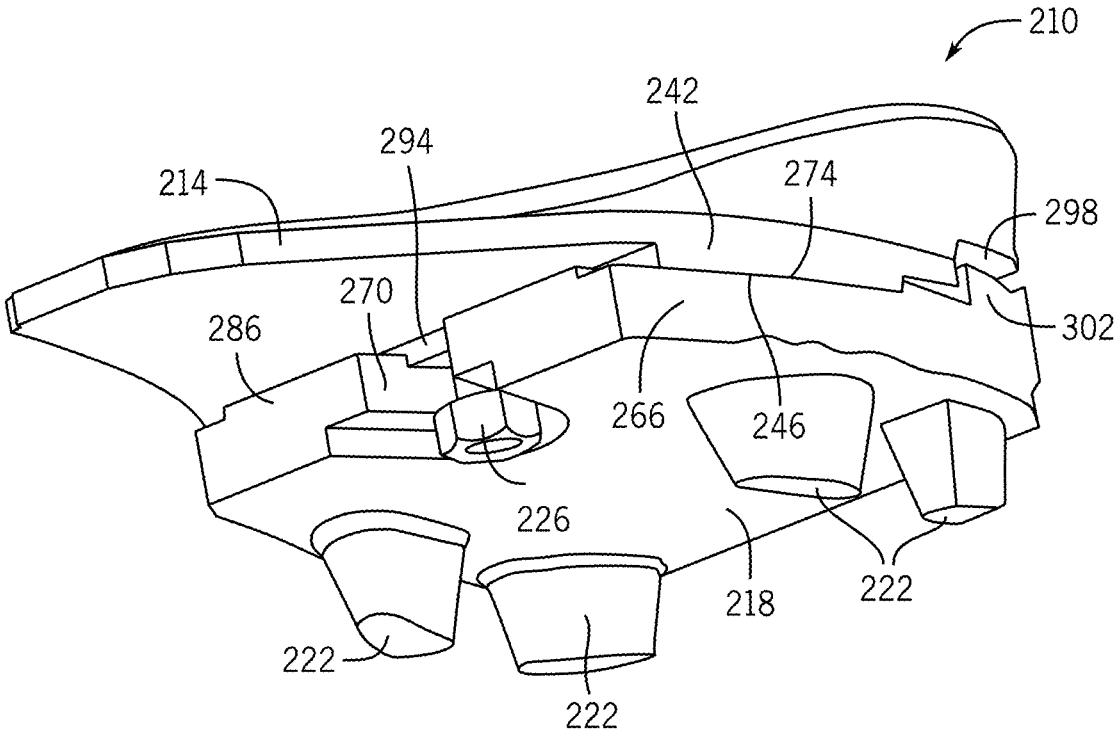
FIG. 10 is another perspective view of the heel assembly of FIG. 9.

With reference to FIGS. 9 and 10, a heel assembly 210 is illustrated with a base 214 and a breakaway portion 218 with cleats 222. A frangible fastener 226 is positioned in a first region 230, and the frangible fastener 226 releasably couples the breakaway portion 218 the base 214. As disclosed herein, the breakaway portion 218 is released from the base 214 in response to the application of a threshold force applied to a second region 234, where the second region 234 is posterior the first region 230. A pivot interface 236 (FIG. 11) is between the base 214 and the breakaway portion 218, and the pivot interface 236 is positioned between the first region 230 and the second region 234. In the illustrated embodiment, the pivot interface 236 defines a pivot axis 237 that is approximately horizontal.

Figure 11:
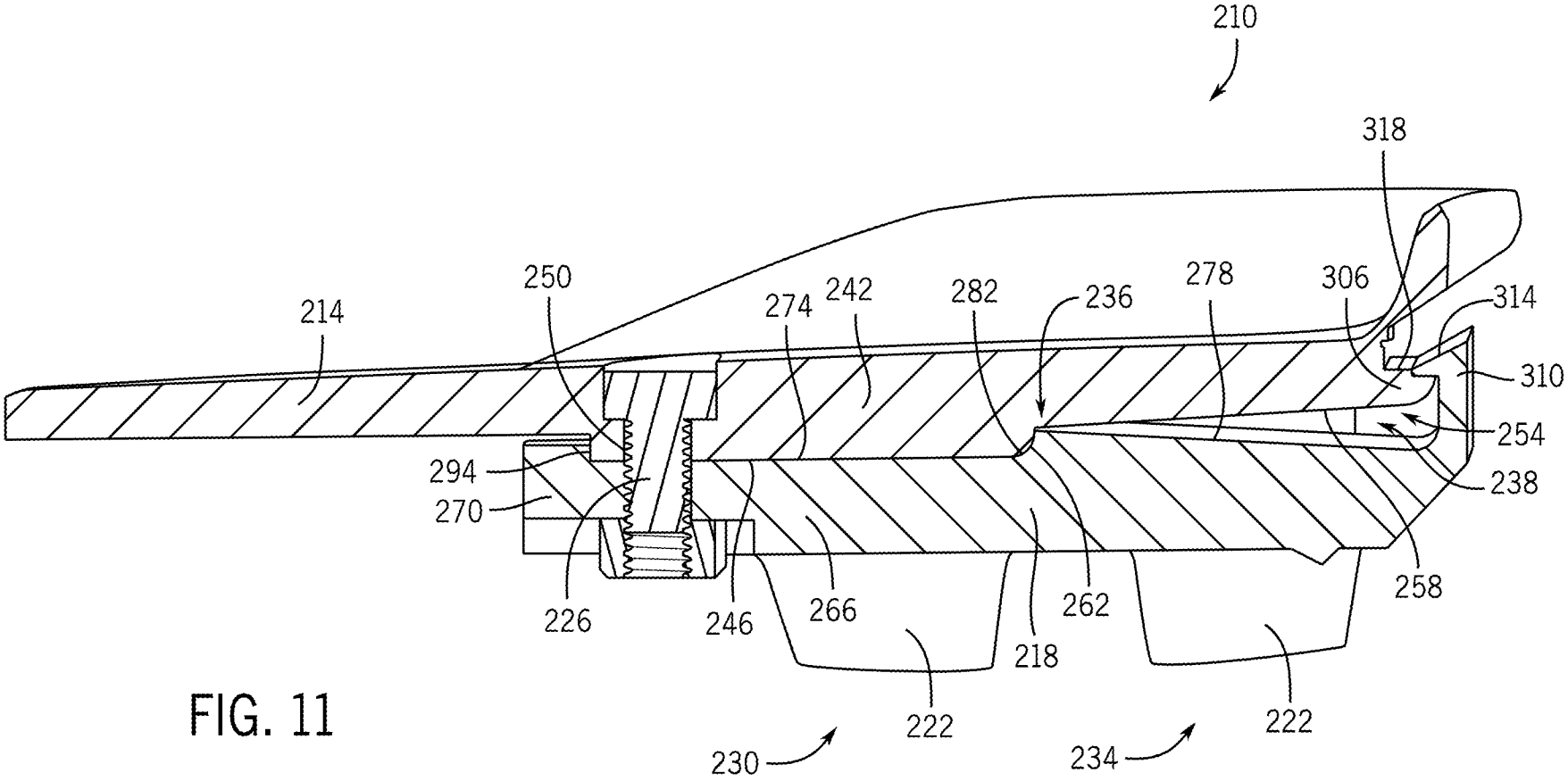
FIG. 11 is a cross-sectional view of the heel assembly of FIG. 9.

With reference to FIG. 11, the heel assembly 210 further includes a gap 238 positioned between the breakaway portion 218 and the base 214. In the illustrated embodiment, the gap 238 is positioned in the second region 234. The base 214 includes a base mount 242 positioned within the first region 230. The base mount 242 includes an interface surface 246 and an aperture 250 formed in the interface surface 246. In the illustrated embodiment, the frangible fastener 226 is at least partially positioned within the aperture 250.

With continue reference to FIG. 11, the base 214 includes a cutout 254 positioned in the second region 234. The cutout 254 includes a cutout surface 258 spaced apart from the breakaway portion 218. In the illustrated embodiment, the base 214 includes an arcuate surface 262 positioned between the interface surface 246 and the cutout surface 258.

With reference to FIG. 10, the breakaway portion 218 includes a breakaway mount 266 including a slot 270. The frangible fastener 226 is at least partially positioned within the slot 270. In the illustrated embodiment, the breakaway portion 218 is coupled to the base 214 with only the single frangible fastener 226. In some embodiments, the frangible fastener 226 includes a bolt and a nut. In some embodiments, the frangible fastener is size "M5".

With reference to FIG. 11, the breakaway mount 266 includes an interface surface 274, and the interface surface 274 abuts the base 214 when the breakaway portion 218 is coupled to the base 214. In the illustrated embodiment, the breakaway portion 218 includes a ramp surface 278 and an arcuate surface 282 positioned between the interface surface 274 and the ramp surface 278.

With reference to FIG. 10, in the illustrated embodiment, the breakaway portion 218 includes a ridge 286 extending from the interface surface 274, and the ridge 286 abuts the base 214 when the breakaway portion 218 is coupled to the base 214. In the illustrated embodiment, the base mount 242 includes an anterior surface 294, and the ridge 286 abuts the anterior surface 294 when the breakaway portion 218 is coupled to the base 214.

With continued reference to FIGS. 9 and 10, the base 214 includes a first lateral notch 298, and the breakaway portion 266 includes a first finger 302 at least partially positioned within the first lateral notch 298 when the breakaway portion 218 is coupled to the base 214. In some embodiments, the first finger 302 is hook-shaped, or a flat bumper. In the illustrated embodiment, a similar lateral notch and finger arrangement is provided on each of the lateral sides of the heel assembly 210. The finger 302 on the side of the breakaway portion 218 provides rotational stability between the breakaway portion 218 and the base 214.

With reference to FIGS. 9 and 11, the base 214 includes a ledge 306. In the illustrated embodiment, the ledge 306 extends in a posterior direction. The breakaway portion 218 includes a finger 310 with a hook 314 abutting a top surface 318 of the ledge 306 when the breakaway portion 218 is coupled to the base 214. The finger 310 on the rear of the breakaway portion 218 provides lateral stability between the breakaway portion 218 and the base 214.

Figure 12A:
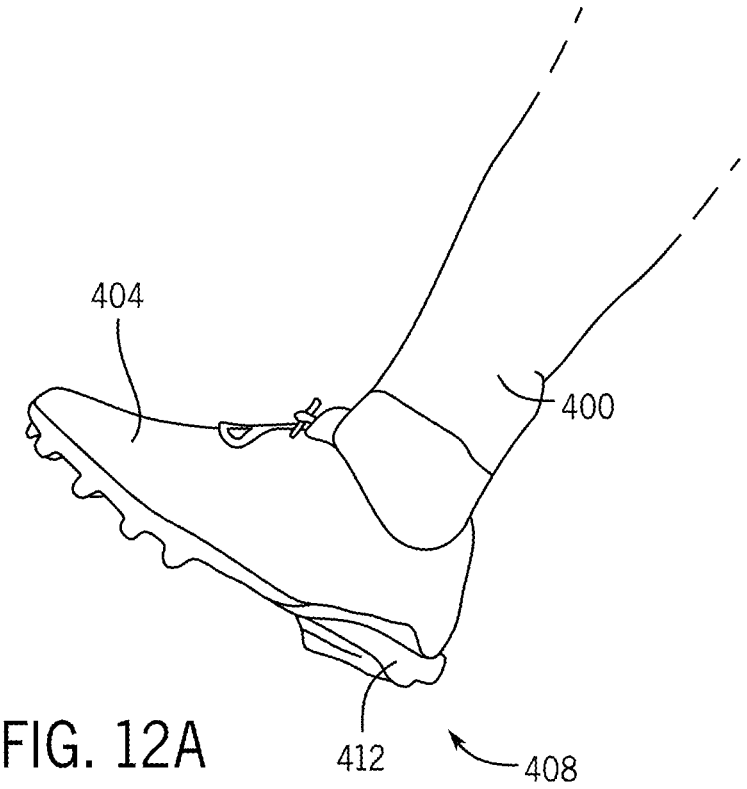
FIG. 12A is a side view of a user wearing a shoe with a breakaway portion shown in an attached configuration.
Figure 12B:
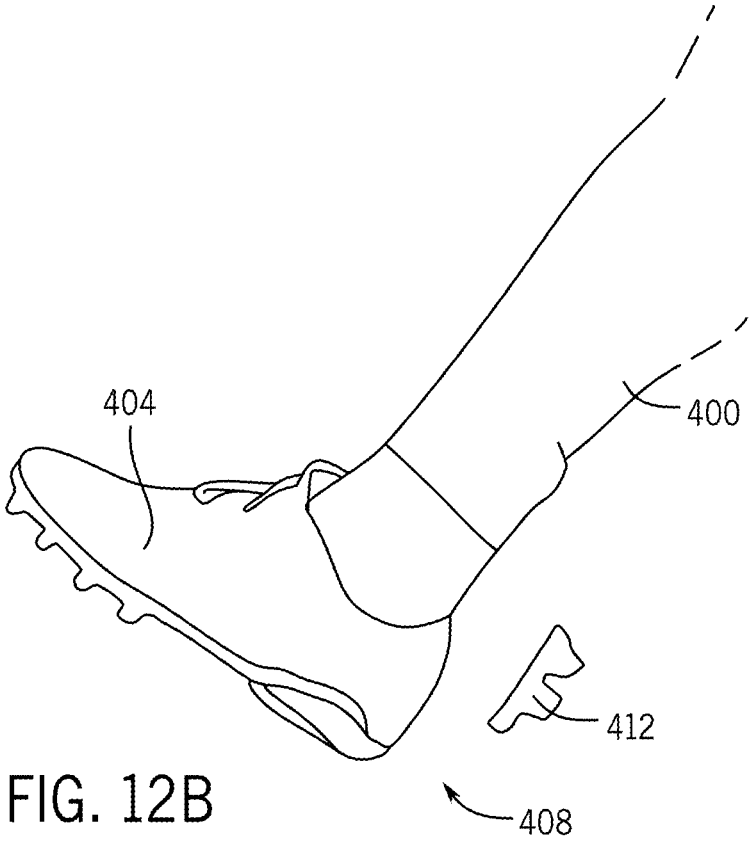
FIG. 12B is a side view of the shoe of FIG. 12A, with the breakaway portion shown in a released configuration.

With reference to FIGS. 12A and 12B, a user 400 is illustrated wearing a shoe 404 with a heel assembly 408 as detailed herein. The heel assembly 408 includes a breakaway portion 412 that releases from the remainder from the shoe 404. FIG. 12A illustrates the user 400 about to land in a position that risks injury (e.g., landing in a "position of risk"). FIG. 12B illustrates the breakaway portion 412 releasing from the remainer of the shoe 404 such that the user 400 moves forward and alleviates or otherwise mitigates the risk of injury. The release of the breakaway portion 412 decreases the impact force by allowing the foot to slide. Secondly, from this position of risk with the body well behind the foot on impact, when the foot slides, the athlete will likely fall or, at a minimum, not have a stable foot to twist off of. Advantageously, if the foot is not solidly anchored in the ground, the ACL cannot tear. The design disclosed herein is stable at all other times, represents a very small visual change, and adds little if any weight.

Various features and advantages are set forth in the following claims.

What is claimed is:

1. A heel assembly comprising:

a base;

a breakaway portion;

a frangible fastener positioned in a first region, wherein the frangible fastener releasably couples the breakaway portion to the base; wherein the heel assembly is movable between an attached configuration and a released configuration; wherein the breakaway portion is attached to the base in the attached configuration and wherein the breakaway portion is released from the base in the released configuration; wherein the heel assembly moves from the attached configuration to the released configuration in response to application of a threshold force applied to a second region, the second region is posterior the first region; and a gap positioned in the second region between the breakaway portion and the base when the heel assembly is in the attached configuration;

a pivot interface between the base and the breakaway portion when the heel assembly is in the attached configuration, wherein the pivot interface is positioned between the first region and the second region.

2. The heel assembly of claim 1, wherein the base includes a base mount positioned within the first region, wherein the base mount includes an interface surface and an aperture formed in the interface surface; wherein the frangible fastener is at least partially positioned within the aperture.

3. The heel assembly of claim 2, wherein the base includes a cutout positioned in the second region, wherein the cutout includes a cutout surface spaced apart from the breakaway portion.

4. The heel assembly of claim 3, wherein the base includes an arcuate surface positioned between the interface surface and the cutout surface.

5. The heel assembly of claim 1, wherein the breakaway portion includes a breakaway mount including a slot, wherein the frangible fastener is at least partially positioned within the slot.

6. The heel assembly of claim 5, wherein the breakaway mount includes an interface surface, wherein the interface surface abuts the base when the breakaway portion is coupled to the base.

7. The heel assembly of claim 6, wherein the breakaway portion includes a ramp surface and an arcuate surface positioned between the interface surface and the ramp surface.

8. The heel assembly of claim 6, wherein the breakaway portion includes a ridge extending from the interface surface, wherein the ridge abuts the base when the breakaway portion is coupled to the base.

9. The heel assembly of claim 8, wherein the base includes a base mount with an anterior surface, and wherein the ridge abuts the anterior surface when the breakaway portion is coupled to the base.

10. The heel assembly of claim 1, wherein the base includes a first lateral notch and a second lateral notch, and the breakaway portion includes a first finger at least partially positioned within the first lateral notch when the breakaway portion is coupled to the base, and a second finger at least partially positioned within the second lateral notch when the breakaway portion is coupled to the base.

11. The heel assembly of claim 1, wherein the breakaway portion includes at least one cleat.

12. The heel assembly of claim 1, wherein the frangible fastener includes a bolt and a nut.

13. The heel assembly of claim 1, wherein the pivot interface defines a pivot axis, and wherein the pivot axis is horizontal.

14. The heel assembly of claim 1, wherein the base includes a ledge, and wherein the breakaway portion includes a finger with a hook abutting a top surface of the ledge when the breakaway portion is coupled to the base.

15. The heel assembly of claim 1, wherein a size of the gap varies as the breakaway portion moves with respect to the base at the pivot interface.

16. The heel assembly of claim 1, wherein the breakaway portion pivots with respect to the base at the pivot interface when the heel assembly moves from the attached configuration to the released configuration.

17. The heel assembly of claim 1, wherein the base includes a base mount positioned within the first region, wherein the base mount includes an interface surface and an aperture formed in the interface surface; wherein the frangible fastener is at least partially positioned within the aperture; and wherein the breakaway portion includes a breakaway mount including a slot, wherein the frangible fastener is at least partially positioned within the slot.

18. The heel assembly of claim 17, wherein the breakaway mount includes an interface surface, wherein the interface surface abuts the base in the attached configuration; and wherein the breakaway portion includes a ramp surface and an arcuate surface positioned between the interface surface and the ramp surface.

19. The heel assembly of claim 18, wherein the breakaway portion includes a ridge extending from the interface surface; wherein the base mount includes an anterior surface; and wherein the ridge abuts the anterior surface in the attached configuration.

20. The heel assembly of claim 1, wherein the frangible fastener is broken in the released configuration.

* * * * *